US006817565B2

(12) United States Patent
Ben-Porat et al.

(10) Patent No.: US 6,817,565 B2
(45) Date of Patent: Nov. 16, 2004

(54) TAKE-UP SHAFT FOR CLEANING CYLINDER DEVICE

(75) Inventors: Avi Ben-Porat, Norwalk, CT (US); James Freebairn, Stamford, CT (US); Edward Marganski, Ansonia, CT (US); John Marganski, Ansonia, CT (US); Daniel Marselli, Ansonia, CT (US)

(73) Assignee: Baldwin Graphic Systems, Inc., Shelton, CT (US)

( * ) Notice: Subject to any disclaimer, the term of this patent is extended or adjusted under 35 U.S.C. 154(b) by 0 days.

(21) Appl. No.: 10/098,252

(22) Filed: Mar. 14, 2002

(65) Prior Publication Data

US 2002/0145071 A1 Oct. 10, 2002

Related U.S. Application Data

(63) Continuation-in-part of application No. 09/442,296, filed on Nov. 19, 1999, now abandoned.

(51) Int. Cl.[7] ..... B65H 19/28

(52) U.S. Cl. ..... 242/532.5; 242/532.6; 242/586.2; 242/587.2; 242/597.6; 242/599.4

(58) Field of Search ..... 242/532.5, 532.6, 242/586.2, 587.2, 599.4, 597.6

(56) References Cited

U.S. PATENT DOCUMENTS

| | | | | | |
|---|---|---|---|---|---|
| 519,465 | A | | 5/1894 | Allen | |
| 3,578,258 | A | * | 5/1971 | Heine et al. | 242/586.4 |
| 4,266,740 | A | * | 5/1981 | Ramos et al. | 242/532.6 |
| 5,069,128 | A | | 12/1991 | Hara et al. | 101/425 |
| 5,370,339 | A | | 12/1994 | Moody et al. | 242/597.6 |
| 5,465,919 | A | * | 11/1995 | Kikuchi | 242/532.6 |
| 5,533,689 | A | | 7/1996 | Chalfant | 242/532.5 |
| 6,068,210 | A | | 5/2000 | Risa | 242/532.5 |

FOREIGN PATENT DOCUMENTS

| | | | | |
|---|---|---|---|---|
| IT | 1401528 | | 7/1975 | B41F/35/02 |
| SU | 1379212 | | 3/1988 | B65H/54/64 |
| WO | WO-98/04490 | * | 2/1998 | 242/532.5 |

OTHER PUBLICATIONS

PCT Search Report.

* cited by examiner

*Primary Examiner*—Kathy Matecki
*Assistant Examiner*—Sang Kim
(74) *Attorney, Agent, or Firm*—Morgan & Finnegan, LLP

(57) ABSTRACT

A novel apparatus and method of a take-up shaft used in the cleaning of a cylinder of a printing press. The take-up shaft includes features that allow the securing of a cleaning fabric from a supply roll without the need to physically fix or mount the fabric to the supply roll with screws or other fasteners that could cause the fabric to tear.

6 Claims, 22 Drawing Sheets

TAKE-UP SHAFT FOR CLEANING CYLINDER DEVICE

CROSS-REFERENCE TO RELATED APPLICATIONS

This application is a continuation in part of co-pending U.S. patent application Ser. No. 09/442296 (now abandoned) entitled Cylinder Cleaning Device filed in the name of Avi Ben-Porat et al. on Nov. 19, 1999, the entirety of which is incorporated by reference herein.

FIELD OF THE INVENTION

The present invention relates to a take-up shaft used for the cleaning of a cylinder of a printing press and more particularly, to a novel device and method of attaching a cleaning cloth to the take-up shaft for small printing presses.

BACKGROUND OF THE INVENTION

One of the more difficult and time consuming tasks in the operation to clean a cylinder used in a printing press is the need to periodically remove and replace the cleaning fabric used in cleaning the cylinder.

In a cylinder cleaner in which a supply of cleaning fabric is supplied to a cleaning fabric take-up roll, the cleaning fabric historically is drawn off a supply roll and secured to the take-up shaft by means of a plurality of nails or screws. The supply shaft containing the cleaning fabric is then installed onto two support members bolted to the main frame of the printing press.

In order to install or remove the supply roll and take-up roll from the support members, an operator first inserts the supply roll onto the support members and then attaches the cleaning fabric to the take-up roll by physically hammering or screwing the cleaning fabric to the take-up roll. This is accomplished by drawing out some of the cleaning fabric from the supply roll, attaching the cleaning fabric to the take-up roll and then rolling up the excess cleaning fabric onto the take-up roll, and then connecting the take-up roll to the support members. Alternatively, the cleaning fabric is attached to the take-up shaft before the supply roll is attached to the support members.

In order to remove the cleaning fabric from the take-up shaft, the cleaning fabric must be physically taken off the take-up shaft which can ruin the take-up shaft or rip the cleaning fabric. Since space is limited, especially in small printing presses, the ability to hammer or screw the cleaning fabric to the take-up shaft is problematic. Therefore, a need exists for a cleaning fabric take-up shaft that easily secures the cleaning fabric to the take-up shaft without the need to physically hammer or screw the fabric to the take-up shaft.

Additionally, the used cleaning fabric is typically removed from the cleaning device by unwinding the used fabric from the take-up shaft, which is permanently secured to the support frame. Therefore, a need exists for an efficient system for securing the supply roll and take-up shaft onto the printing press frame.

SUMMARY OF THE INVENTION

The shaft solves these and other needs associated with a cleaning cylinder device. The shaft was developed to maximize production time by reducing press down time during which the operators of a printing press insert and remove cleaning fabric supply roll and used cleaning fabric of a cylinder cleaner.

Features of the shaft for a cylinder cleaning device include a rigid one piece frame. Generally described, the rigid one piece frame supports a cleaning fabric supply roll, a cleaning fabric take-up shaft, and an inflatable bladder assembly. The shaft includes a rod that may be mounted or disposed by a locking connection and an axial groove for securing the cleaning fabric from the supply roll to the take-up roll. Both the supply roll and the take-up shaft are removably attached to the one piece frame.

In addition, shaft includes a rod that may be mounted or disposed by a sliding connection, inserted into a cylindrical sockets for securing the cleaning fabric from the supply roll to the take-up roll.

The take-up shaft further includes a first member and a second member. The first member has a planar section and a first end and a second end. The first end is larger than the second end. The second member has a proximal end and a distal end. The distal end is larger than the proximal end. In addition, the overall length of the second member is smaller than that of the first member. The second member is disposed over the first member in such a way that the proximal end of the second member is adjacent to the second end of the first member and the distal end of the second member is adjacent to the first end of the first member.

These, and other aspects of the shaft, are described in the following brief and detailed description of the drawings.

BRIEF DESCRIPTION OF THE DRAWINGS

Further aspects of the instant invention will be more readily appreciated upon review of the detailed description of the preferred embodiments included below when taken in conjunction with the accompanying drawings, of which.

DETAILED DESCRIPTION OF THE INVENTION

Figure 1:
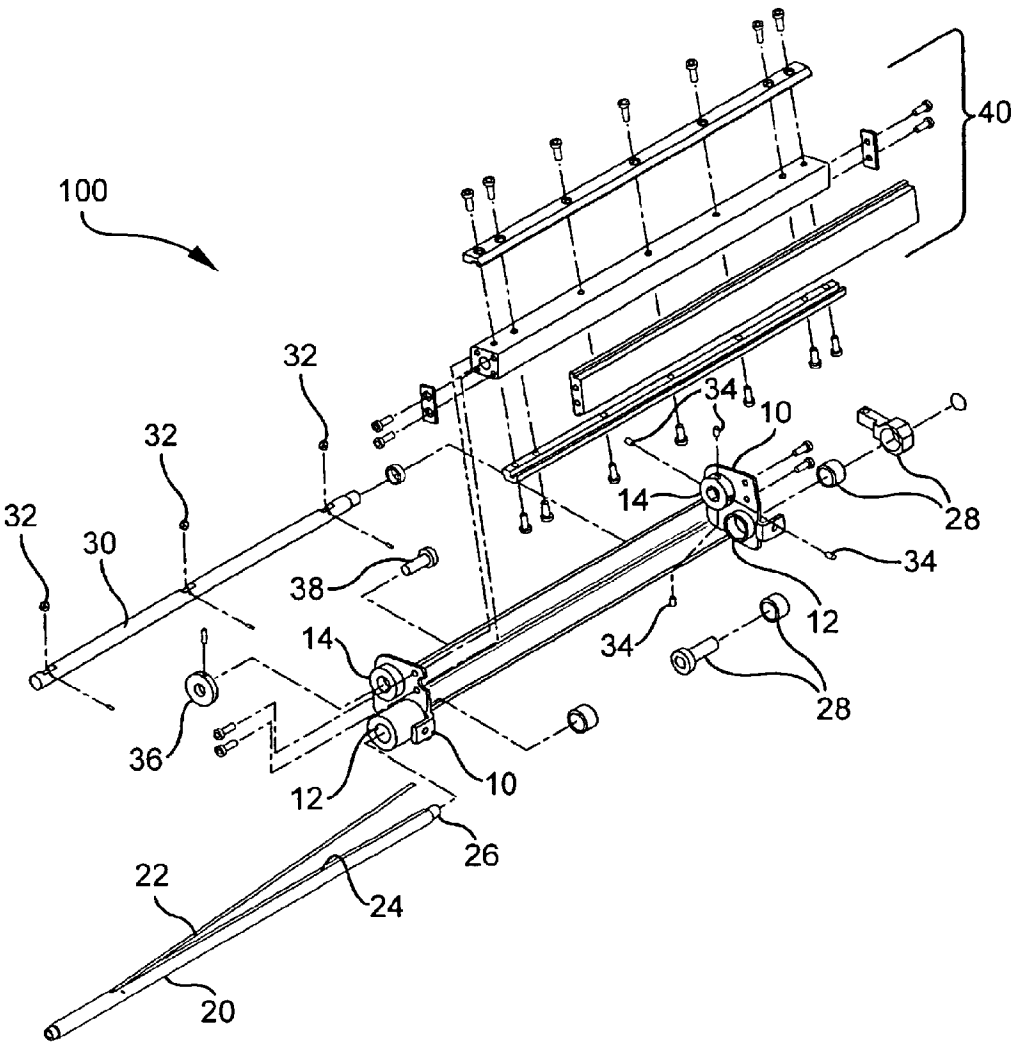
FIG. 1 is an exploded view of a take-up shaft.

In FIG. 1, a cylinder cleaning device 100 is shown. In general, the cleaning device 100 includes a frame 10 for holding a cleaning fabric take-up shaft 20, a cleaning fabric supply shaft 30, and an inflatable bladder assembly 40, for pressing cleaning fabric against the cylinder to be cleaned. It is to be understood that any mechanism other than the inflatable bladder 40, such as a blade, may be used to contact the cleaning fabric with the cylinder to be cleaned.

More specifically, the frame 10 is removably attachable to a printing press frame (not shown). The frame 10 defines a rigid cartridge housing containing the cleaning fabric take-up shaft 20 and the cleaning fabric supply shaft 30. The rigid cartridge housing includes two side members 16 and a brace member 18. The side members 16 include a first pair of sockets 12 for receiving the take-up shaft 20 and a second pair of sockets 14 for receiving the supply shaft 30. The brace member 18 connects the two side members 16, enabling the cleaning fabric take-up shaft 20 and the cleaning fabric supply shaft 30 to be attached to the frame 10 prior to insertion into the printing press frame. The rigid cartridge housing also supports the inflatable bladder. assembly 40. Thus, the frame 10 supporting the cleaning fabric take-up shaft 20, the cleaning fabric supply shaft 30 and the inflatable bladder assembly 40 is inserted and removed from the printing press frame as a complete unit. The frame 10 is constructed using one sheet of material, i.e. aluminum or steel, although in alternate embodiments, the frame 10 includes other metals, alloys or composites generally known in the art, molded plastic, or the like.

The take-up shaft 20 is used for the winding of cleaning fabric after it has been used to clean the cylinder. The shaft 20 includes a hingeably mounted rod 22 and an axial groove 24. As illustrated, the rod 22 aligns with the groove 24 so that the rod 22 may be inserted in the groove 24. Preferably, a magnet is imbedded into the groove 24 to secure the rod 22 in place, although other securing means, such as a latch or adhesive, may be used. The take-up shaft 20 also includes a rectangular extension 26, which preferably includes an extension of the groove 24. The extension 26 is engageable with a cleaning cloth advancement mechanism 28, which serves to rotate the take-up shaft 20. In general, the cleaning fabric advancement mechanism 28 includes a one-way clutch and an advancement arm, which can be actuated by any number of means, such as a hydraulic piston or motor. The cleaning cloth advancement mechanism 28 may be any of the known advancement mechanisms, such as that described U.S. Pat. No. 5,176,080, herein incorporated by reference, or in U.S. Pat. No. 5,450,792, herein incorporated by reference.

Figure 7:
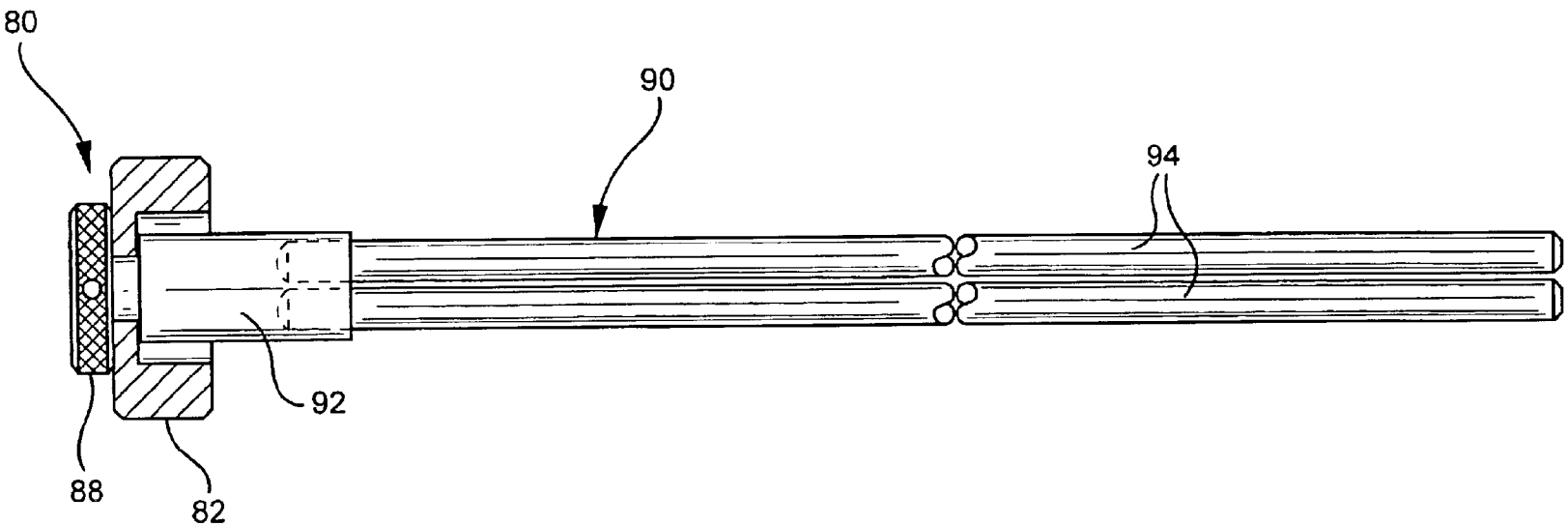
FIG. 7 is a side view of a two pronged take-up shaft.

Depending on the implementation, a take-up shaft 90 is used for the winding of cleaning fabric after it has been used to clean the cylinder. As illustrated in FIG. 7, the shaft 90 includes a support member 92 and two pronged members 94. The two pronged members 94 protrude from the support member 92 and extend parallel to each other. The take-up shaft 90 also includes a securing mechanism 80. The securing mechanism 80 for the take-up shafts will be described in greater detail below.

The supply shaft 30 includes one or more projections 32 extending from the circumference therefrom. The projections 32 are in the form of three wheels spaced along the axis of the supply shaft 30. The circumference of each wheel 32 extends beyond that of the supply shaft 30. Although the wheels 32 are in axial alignment, it is to be understood that each wheel 32 may be spaced at different points on the circumference of the supply shaft 30. Additionally, fewer or more than three wheels 32 may be used. The projections may include one or more ridges extending part of or the entire length of the shaft 30.

Cooperating with the supply shaft 30 is a spring loaded securing mechanism 36, 38. This mechanism will be described in greater detail with reference to FIG. 4. Also cooperating with the supply shaft 30 is a series of nylon-tipped screws 34. When the supply shaft 30 is inserted into the opening 14 in the frame 10, the nylon-tipped screws 34 are tightened around the shaft 30, thereby supplying a braking force. As will be appreciated by those skilled in the art, such a braking force prevents bunching of cleaning fabric.

Figure 2:
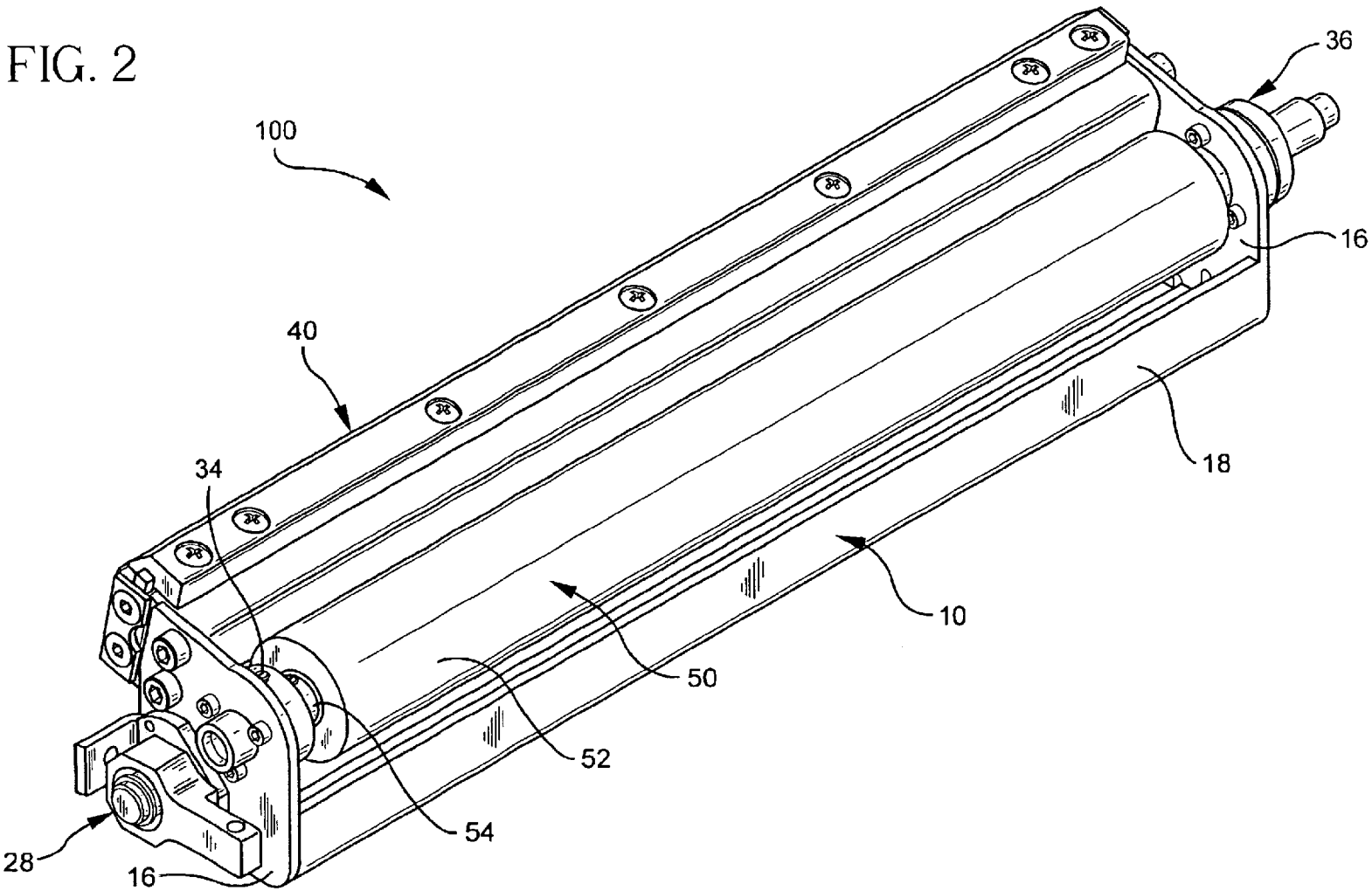
FIG. 2 is a side perspective view of the assembled shaft of FIG. 1.
Figure 3:
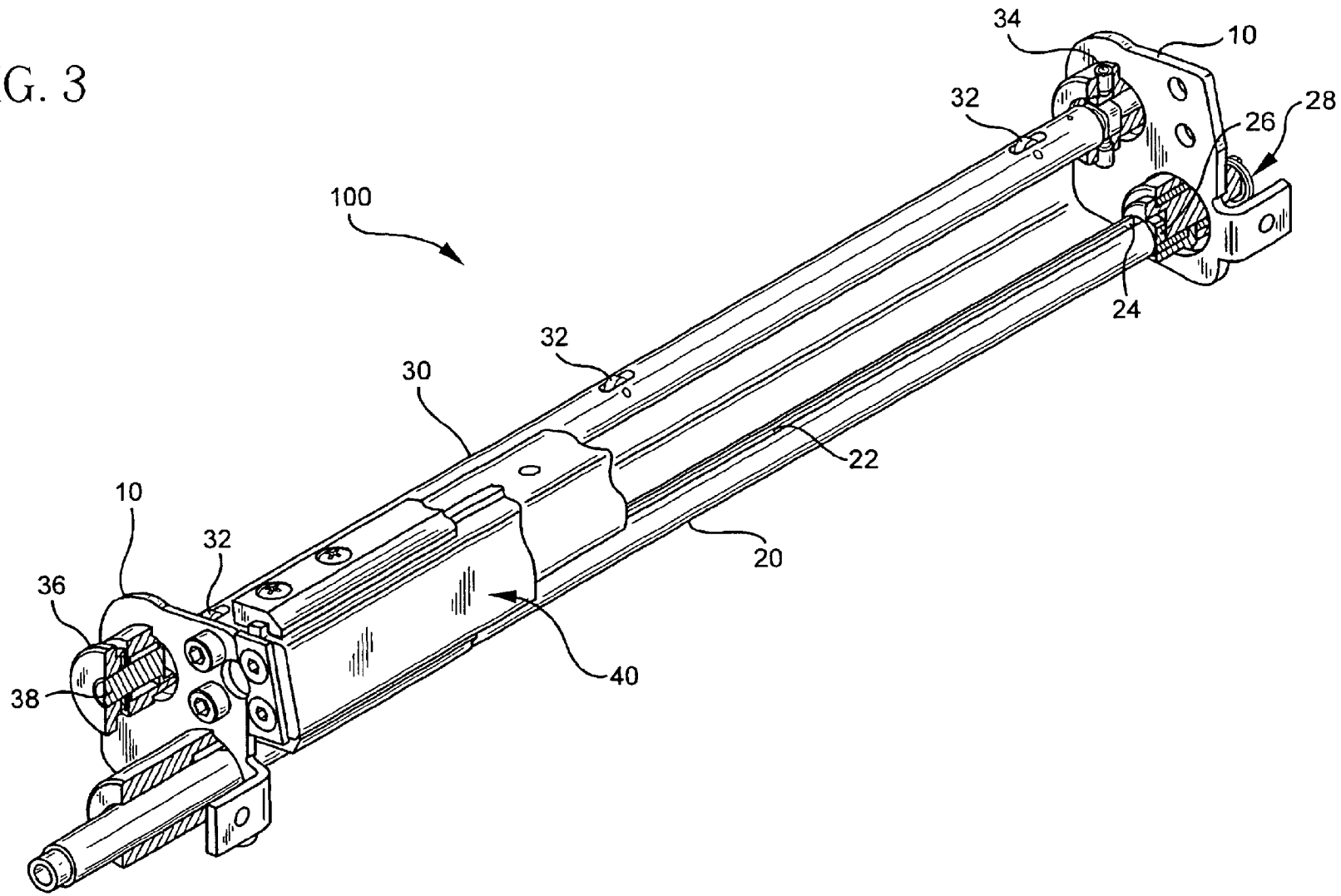
FIG. 3 is another side perspective view, partly sectional, of the assembled shaft of FIGS. 1 and 2.

The assembled device 100 is shown in FIGS. 2 and 3. As illustrated, a cleaning fabric supply roll 50 can be inserted on the supply shaft 30. In general, the supply roll 50 comprises cleaning fabric 52 wound on a cardboard core 54. The procedure for inserting the supply roll 50 on the supply shaft 30 will be described in greater detail below.

The supply shaft 30 and the core of the supply roll 50 interlock in a key arrangement. For example, the shaft 30 includes a ridge, and the core include a mating groove.

Figure 4:
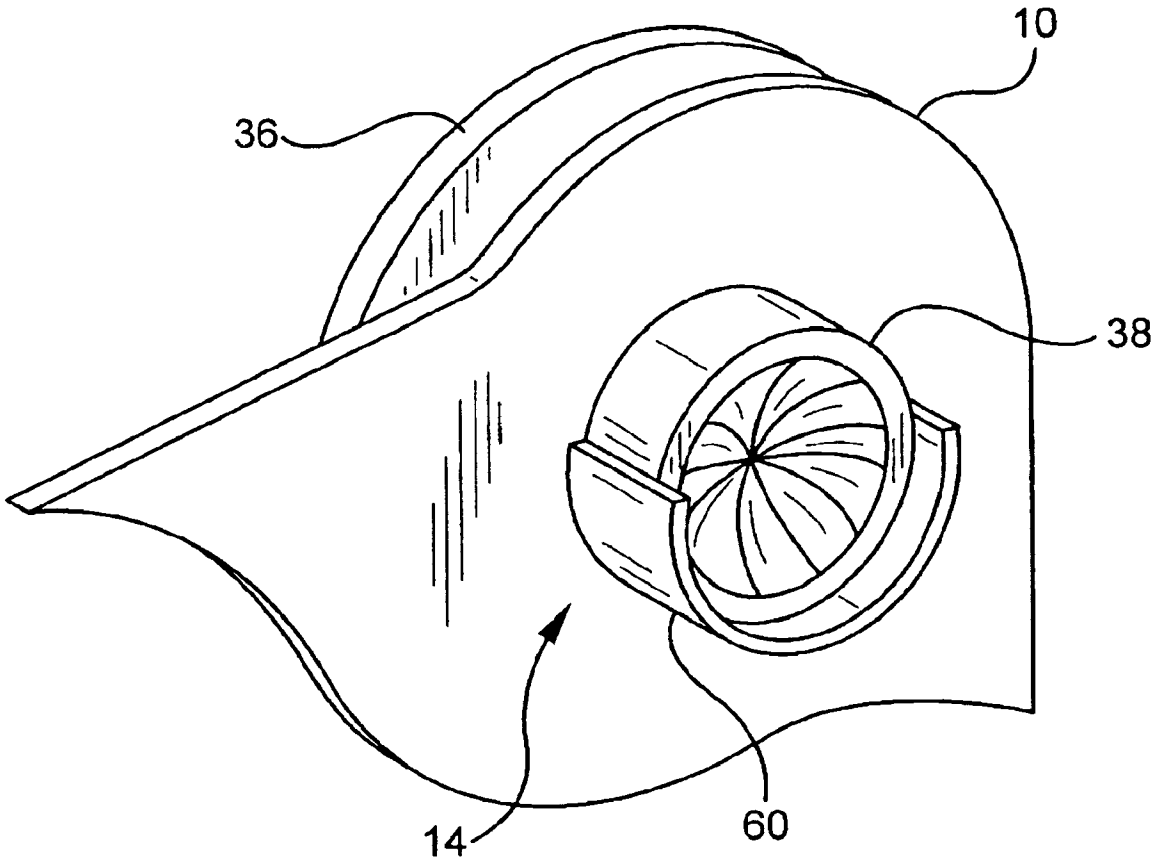
FIG. 4 is an enlarged perspective of a portion of the shaft of FIGS. 1–3.

A close-up of a socket 14 will now be described in greater detail with reference to FIG. 4. As shown, the securing mechanisms 36, 38 are secured together with mechanism 38 extending through the socket 14. Furthermore, the securing member 38 includes a cupped or hollow surface for receiving the end of the supply shaft 30. Additionally, a U-shaped support 60 is secured to the interior surface of the frame 10 when the securing mechanism 36 is drawn away from the frame 10, mechanism 38 is partially drawn out of the socket 14. As discussed in greater detail below, when the mechanism 36 is released, a spring (not shown) draws the mechanism 38 back into the socket 14 and the mechanism 36 back towards the frame 10.

Figure 5:
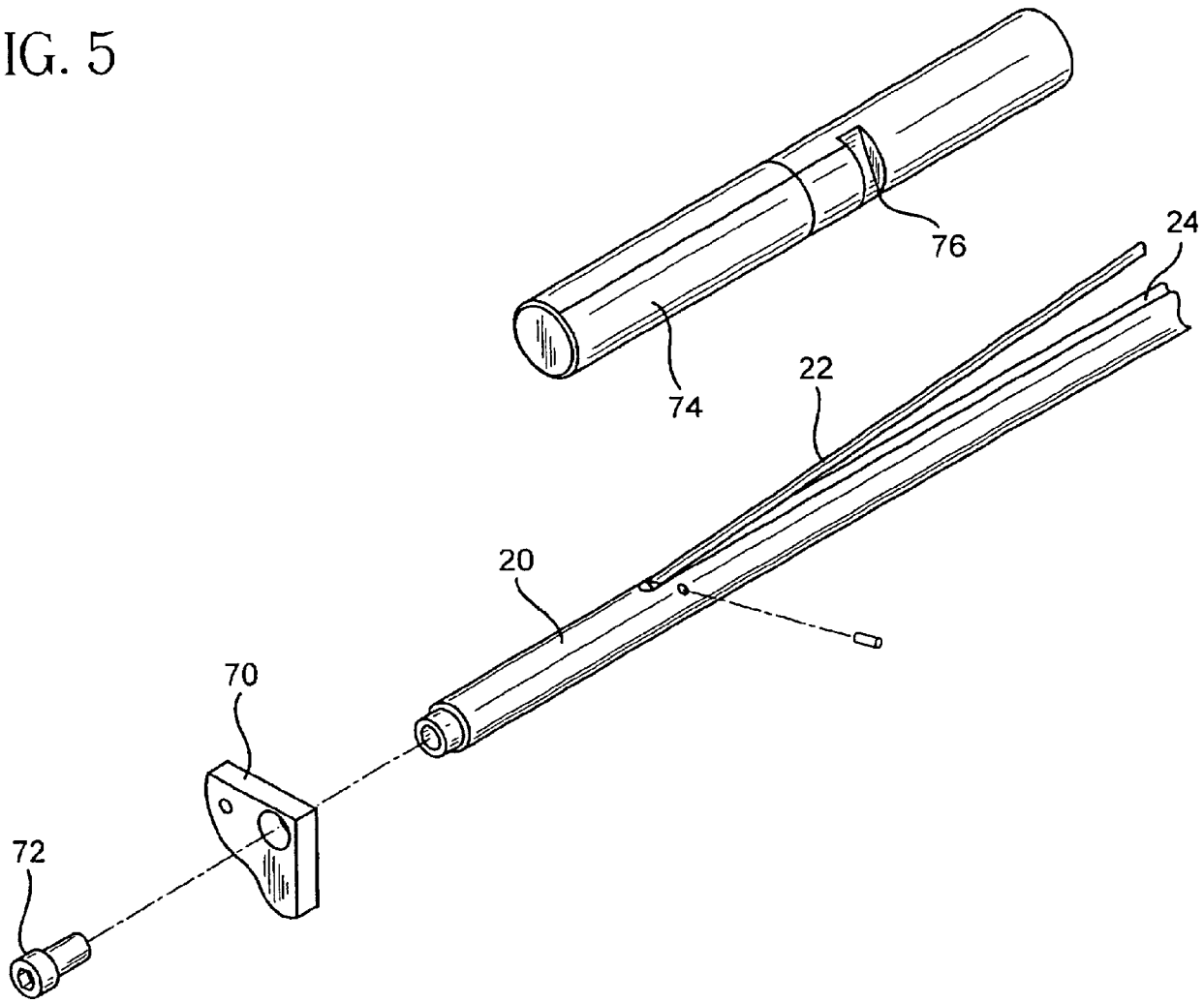
FIG. 5 is an exploded view of a take up shaft retaining mechanism.

FIG. 5 illustrates a mechanism for securing the take up shaft in place. As shown, an extension, here formed as a wedge, 70 is rotatably secured to the end of the take up shaft 20 by means of a screw 72 or rivet. The securing mechanism also includes a rod 74 having a groove 76 cut therein. The rod 74 is secured to either the frame end or the press frame (not shown) in a position such that when the take up shaft 20 is inserted into the frame 10, the wedge 70 may be rotated and engaged with the groove 76. Engagement of the wedge 70 with the groove 76 prevents the shaft 20 from withdrawing axially through the frame 10.

Figure 6A:
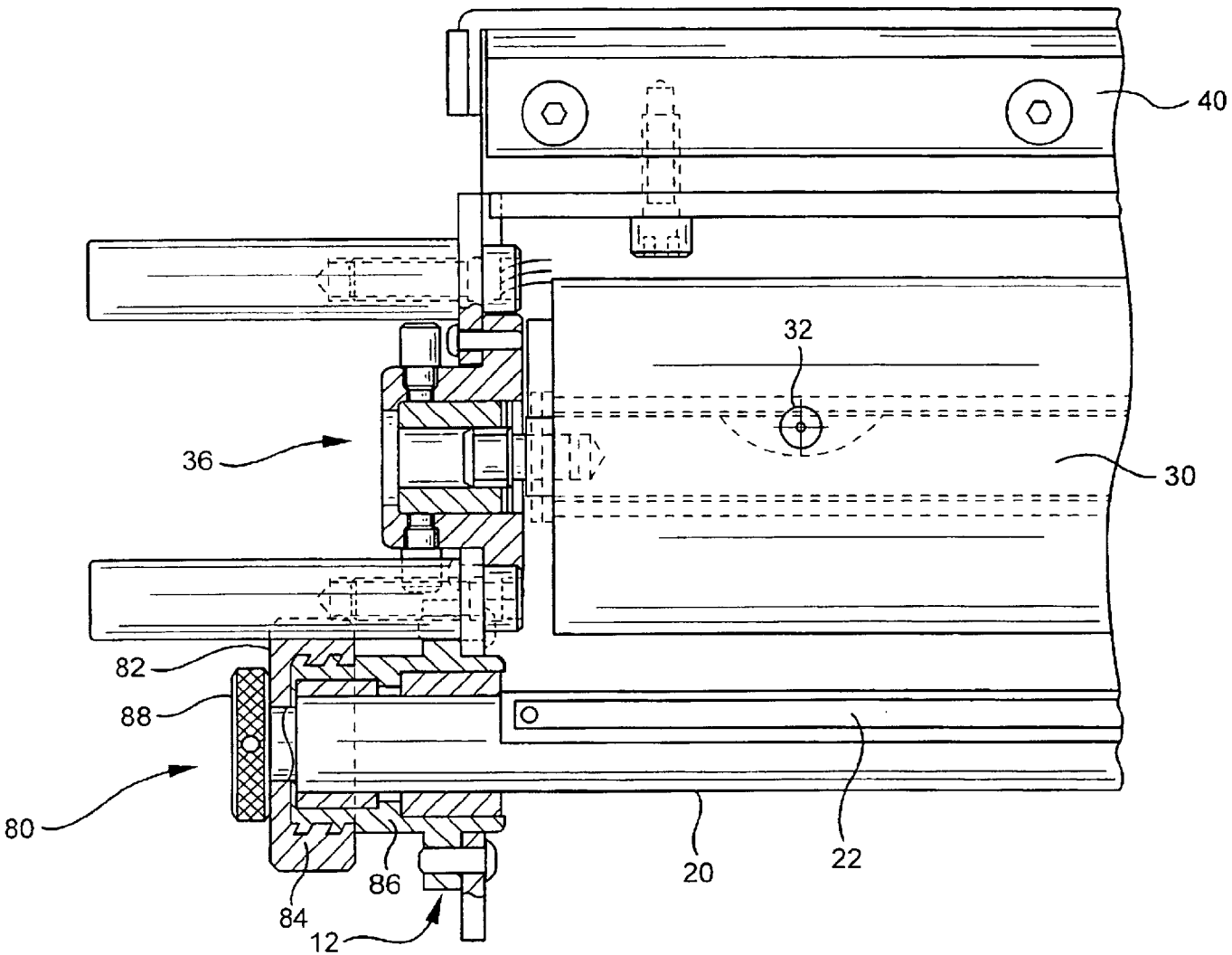
FIG. 6*a* is a top view of a take-up shaft retaining mechanism.
Figure 6B:
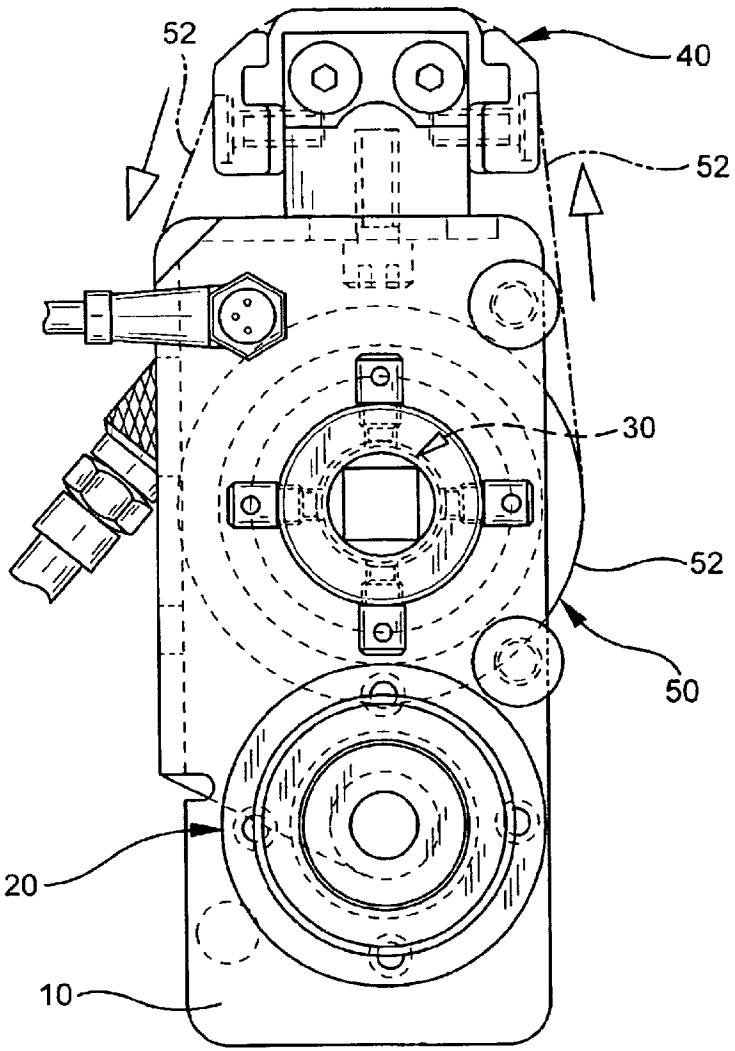
FIG. 6*b* is a front view of a take-up shaft retaining mechanism.

Depending on the implementation, the mechanism for securing the take up shaft in place may be as shown in FIG. 6A and FIG. 6B. The take up shaft securing mechanism 80 comprises a rotatable sleeve 82 attached to the end of the take up shaft 20. As shown, the sleeve has a diameter greater than the socket 12. Furthermore, the sleeve 82 includes a threaded portion on its interior surface which may engage external threads on the socket 12. An extension of the take up shaft 20, which is narrower than the shaft 20 itself, extends through a hole in the center of the sleeve 82.

The securing mechanism 80 further includes a knob 88 fixably secured to the extension of the take up shaft which passes through the sleeve 82. As such, the knob 88 secures the sleeve 82 to the take up shaft 20 while allowing the sleeve 82 to rotate on the extension.

In operation, a cleaning fabric supply roll 50 is inserted axially onto the supply shaft 30. Such insertion is relatively easy, as the wheels 32 exert a relatively low friction force against the cardboard core 54 of the supply roll 50. Additionally, it has been found that the wheels 32 deform the relatively soft cardboard core 54.

Once the cleaning cloth supply roll 50 is inserted on the supply shaft 30, the supply shaft 30 is inserted into the frame 10. This is performed by inserting one end into the socket 14 not having the securing mechanism 36, 38. The other end of the supply shaft 30 is secured into place by first drawing the securing mechanism 36, 38 away from the supply shaft 30 and frame 10. The supply shaft 30 is then rested on the U-shaped support 60. With the supply shaft 30 in position, the securing mechanism 36, 38 is then released and drawn back towards the supply shaft 30 by the spring. The hollow, cupped end of the mechanism 38 thus engages the end of the supply shaft 30, thereby securing it in place. It should be noted that the U-shaped support 60 provides the added benefit of limiting axial movement of the supply roll 50 by abutting the cardboard core 54.

The take up shaft 20 must also be secured to the frame 10. To secure the shaft 20 to the frame 10, the take up shaft 20 is inserted through the sockets 12 until the sleeve 82 abuts the socket 12. By rotating the sleeve 82, the threaded section 84 of the sleeve engages the threaded section of the socket 86, thereby drawing the take up shaft further through the sockets 12 and into an operational position. It should be noted that engagement of the sleeve 82 with the socket 12 secures the take up shaft 20 in place, while allowing rotation of the shaft 20 through either actuation of the advancement mechanism 28 or manual rotation of the knob 88. With the take up shaft secured in place, the cleaning fabric 52 can be wound through the device 100 and secured to the take up shaft 20.

To wind the cleaning fabric 52 through the device 100, it is drawn off of the supply roll 50, threaded around the pad 40, and secured to the take up shaft 20. It should be noted that when drawing the cleaning fabric 52 from the roll 50, the roll 50 and supply shaft 30 rotate together. This occurs because the wheels 32, although having little frictional force axially, have edges that engage the cardboard core 54 and provide a relatively greater radial or angular frictional force. Thus, the cardboard core 54 cannot rotate without also rotating the supply shaft 30.

Securing the cleaning fabric 52 to the take up shaft 20 involves first lifting the rod 22 from the groove 24. The cleaning fabric 52 is then inserted underneath the rod 22, between the rod 22 and take up shaft 20. The rod 22 is then reinserted into the groove 24, thereby securing the cleaning fabric 52 between the rod 22 and take up shaft 20. The magnet helps retain the rod 22 in the groove. Next, the cleaning cloth 52 is prevented from being drawn out of the groove 24 by rotating the take up shaft 20 approximately one revolution. Such revolution may be performed manually by either grasping the take up shaft 20 or rotating the knob 88.

When the supply roll 50 is expended and the used cleaning fabric 52 is completely wound on the take up shaft 20, the present invention allows easy removable of the used cloth 52. First, the take up shaft 20 is unsecured from the device. This is done by either rotating the wedge 70, shown in FIG. 5, out of engagement with the rod 74, or unscrewing the sleeve 82, shown in FIG. 6*a*, from the threaded socket 12. Second, the take up shaft 20 is simply drawn out of the socket 12 a few inches. By drawing the take up shaft 20 out of the frame 10, the used fabric 52 is automatically forced off of the take-up shaft 20 by the force exerted on the fabric 52 by the frame 10 and/or socket 12. With the take-up shaft 20 drawn out of the frame 10 a few inches, the used fabric 52 is freed from the end of the take-up shaft 20 opposite the securing mechanism. Third, the press operator simply pulls the expended cloth 52 off the take-up shaft 20 in an axial direction. It will be appreciated by those skilled in the art that such removal of the used cleaning fabric 52 represents an improvement over the prior art because no time is taken for the unwinding of the used cleaning fabric.

The cleaning fabric of the take-up shaft 90, drawn off the supply roll 30, is inserted between the two pronged members 94 protruding from the support member 92 of the take-up shaft 90. The two pronged members 94 retain the cleaning fabric by mechanically locking or pinching the cleaning fabric between the members 94. The take-up shaft is then rotated approximately one revolution to prevent the cleaning cloth from being pulled out of the space between the pronged members 94. Such revolution may be performed manually by either grasping the take-up roll 90 or rotating the knob 88. The take up shaft 90 is secured to the frame in the same manner as described above for the take-up shaft 20.

Figure 8:
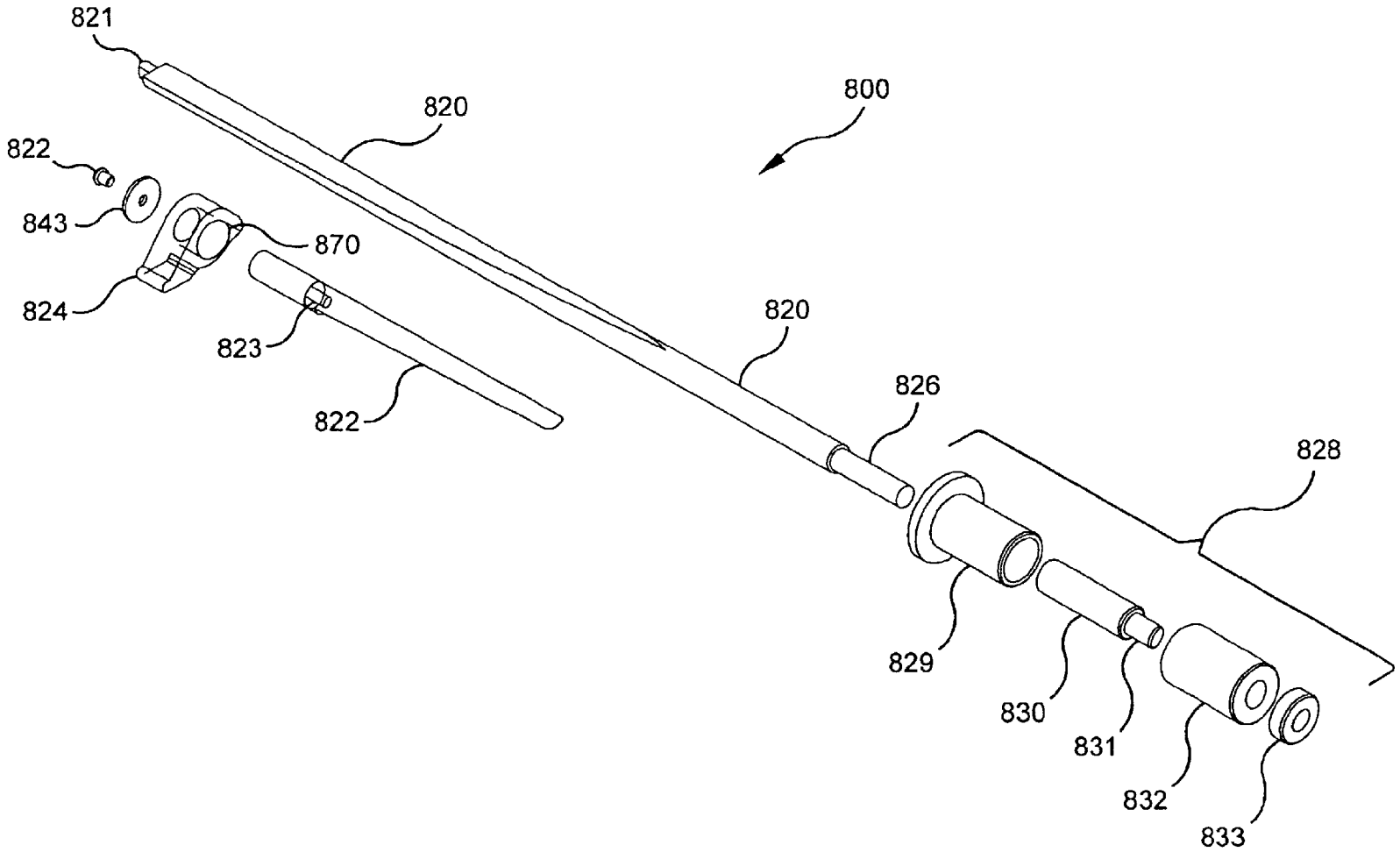
FIG. 8 is an exploded view of a take-up shaft, with a rod that may be mounted or disposed by locking with take-up shaft.

FIG. 8 shows the components of a fully assembled take-up shaft 800, having a first member 820 and a second member 822, wherein the second member may be, but is not necessarily a rod, according to one embodiment of the present invention. As opposed to the rod 22, mounted or disposed by hinging, of the take-up shaft 20, the second member 822, is mounted or disposed to the take-up shaft 820, by locking to the first member 820. An exploded view of a gear side assembly 827, or securing mechanism, is shown, wherein the second member 822 is attached. Also, an exploded view of an operator side assembly 828 is shown, wherein the first member 820 is attached. Additionally, as shown in FIGS. 9 and 10, the first member 820 is attached to the gear side assembly 827 by connecting with the second member 822.

Figure 9:
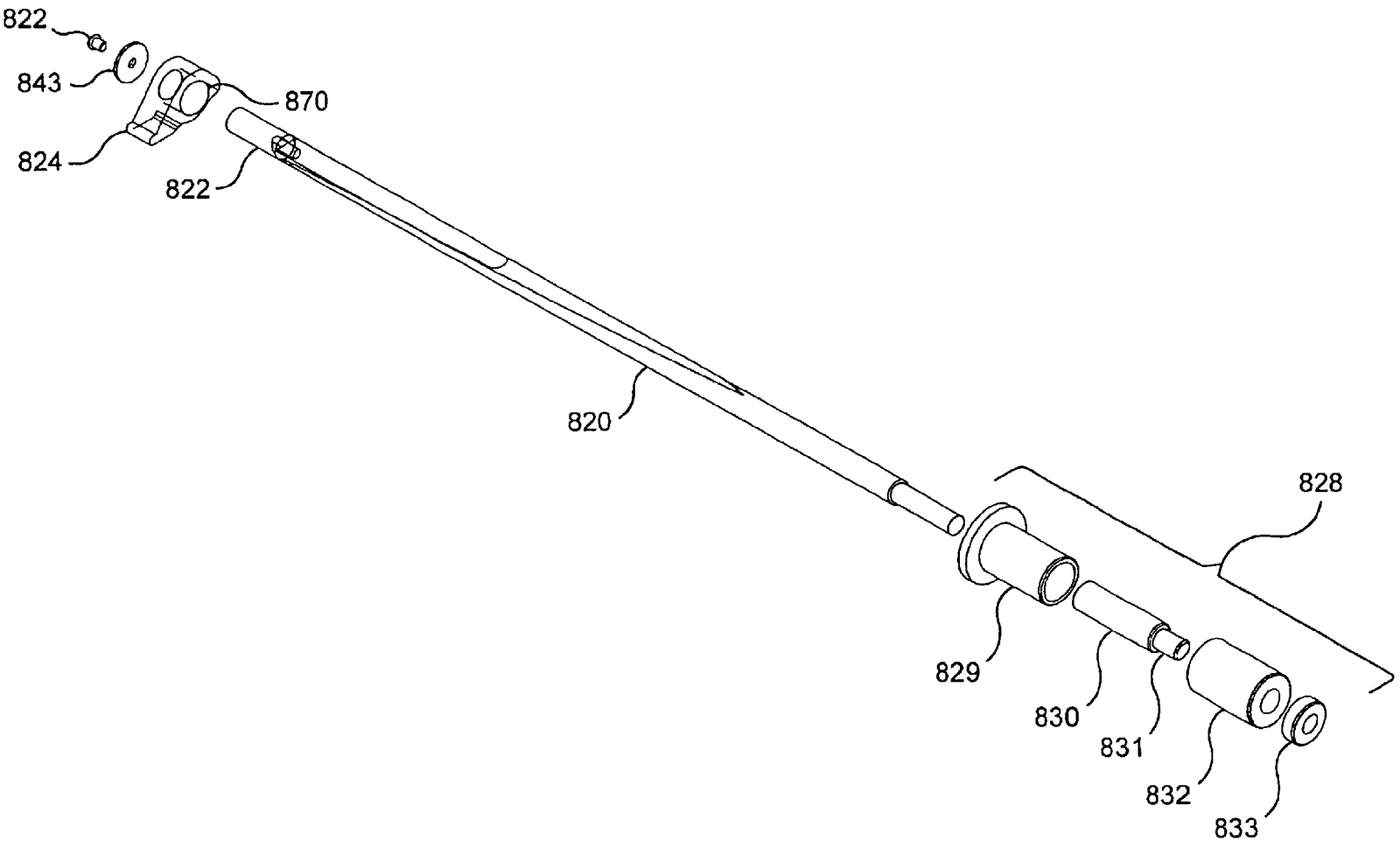
FIG. 9 is a perspective view of the assembled shaft of FIG. 8.
Figure 10:
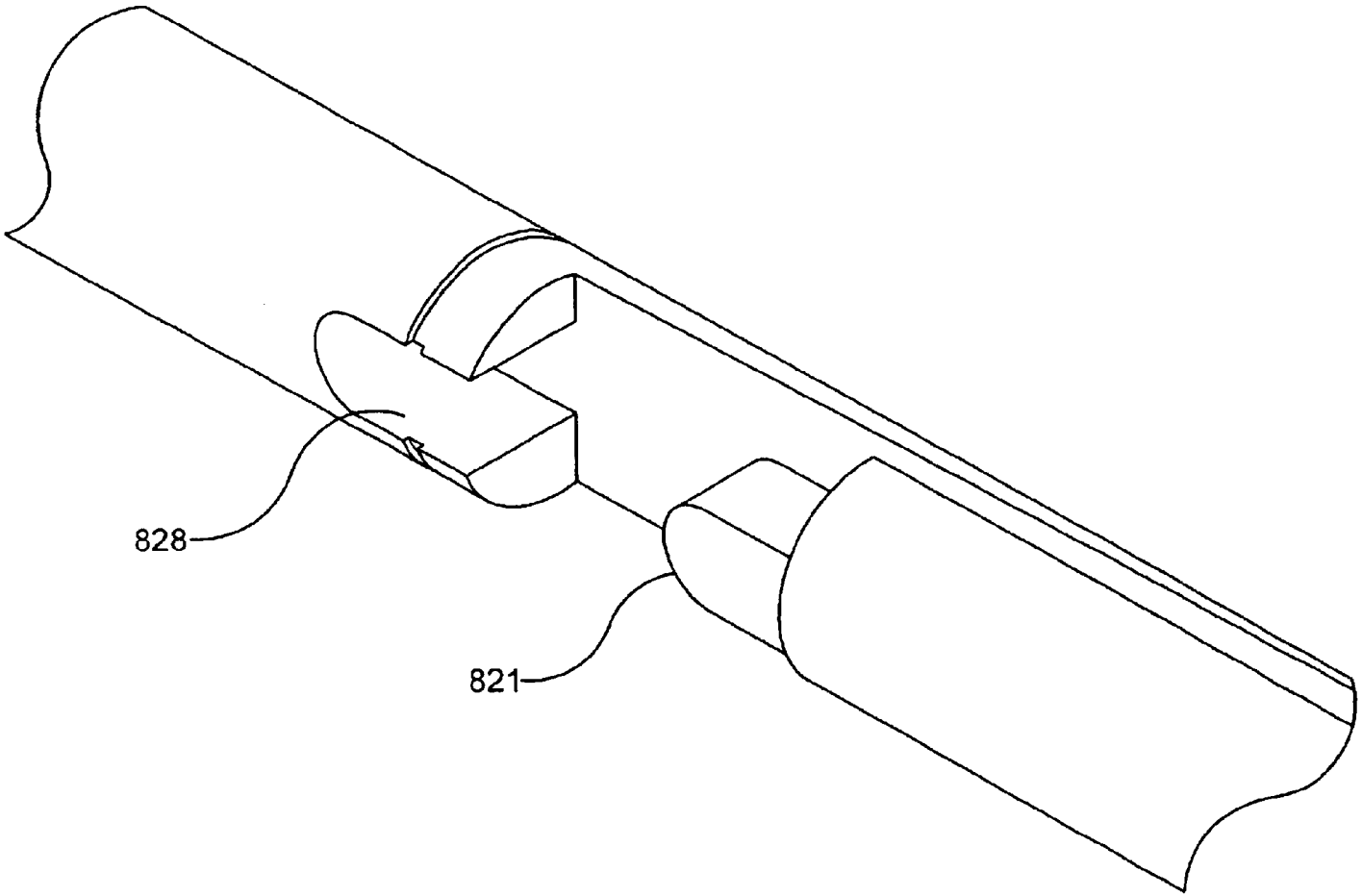
FIG. 10 is an enlarged perspective view of the tab and slot relationship between the rod and the take-up shaft.

FIG. 9 shows the components of a fully assembled take up shaft 800, wherein the second member 822 is placed into an axial groove 824 of the first member 820. A tab 821 is located on the end of the first member 820 that is to be placed into a slot 823 of the second member 822, and thereby attached to the gear side assembly 827, or securing mechanism. The other end of the first member 820 attaches to the operator side assembly 828. The tab and slot connection may contain fewer components, thereby reducing cost of production and improving reliability of repair. FIG. 10 shows a close up view of the tab and slot connection, as described in FIG. 9.

Figure 11:
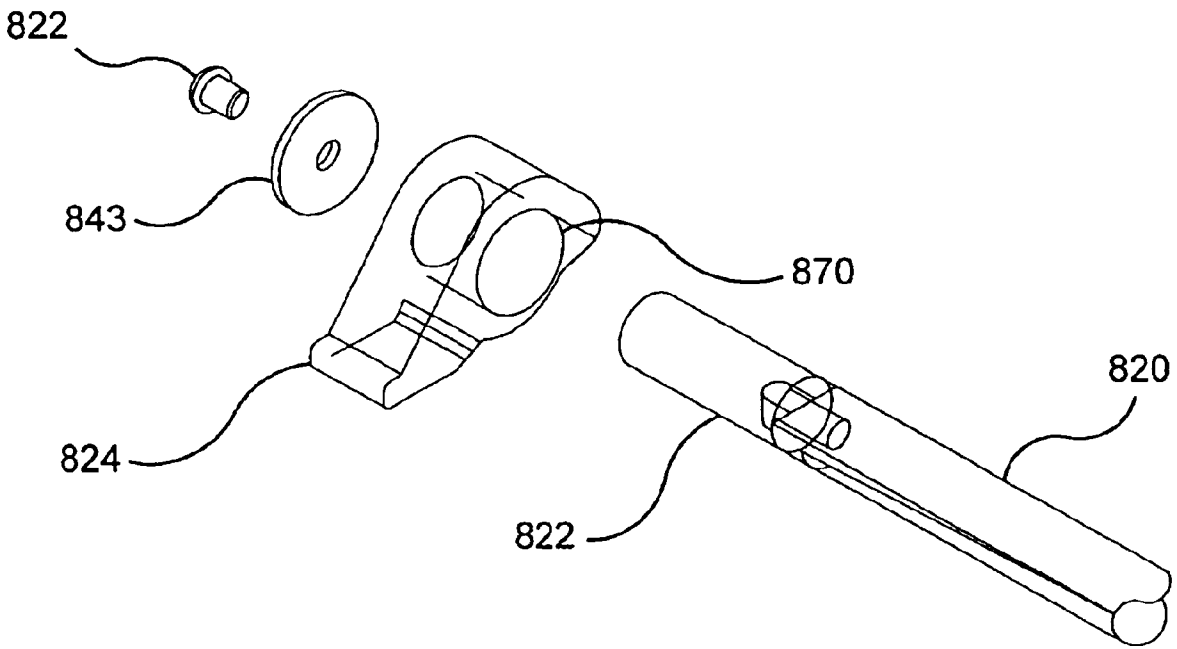
FIG. 11 is an exploded view of the gear side assembly, or securing mechanism, of the take-up shaft.

FIG. 11 shows the components of the gear side assembly 827, or securing mechanism, for the take-up shaft 820 of the present invention. The cylindrical end of the second member 822 slides into the cylindrical opening of a wedge 870. A plate 873 is attached to the cylindrical end of the second member 822 by a screw 872, thereby immobilizing the gear side assembly 827, or securing mechanism.

Figure 12:
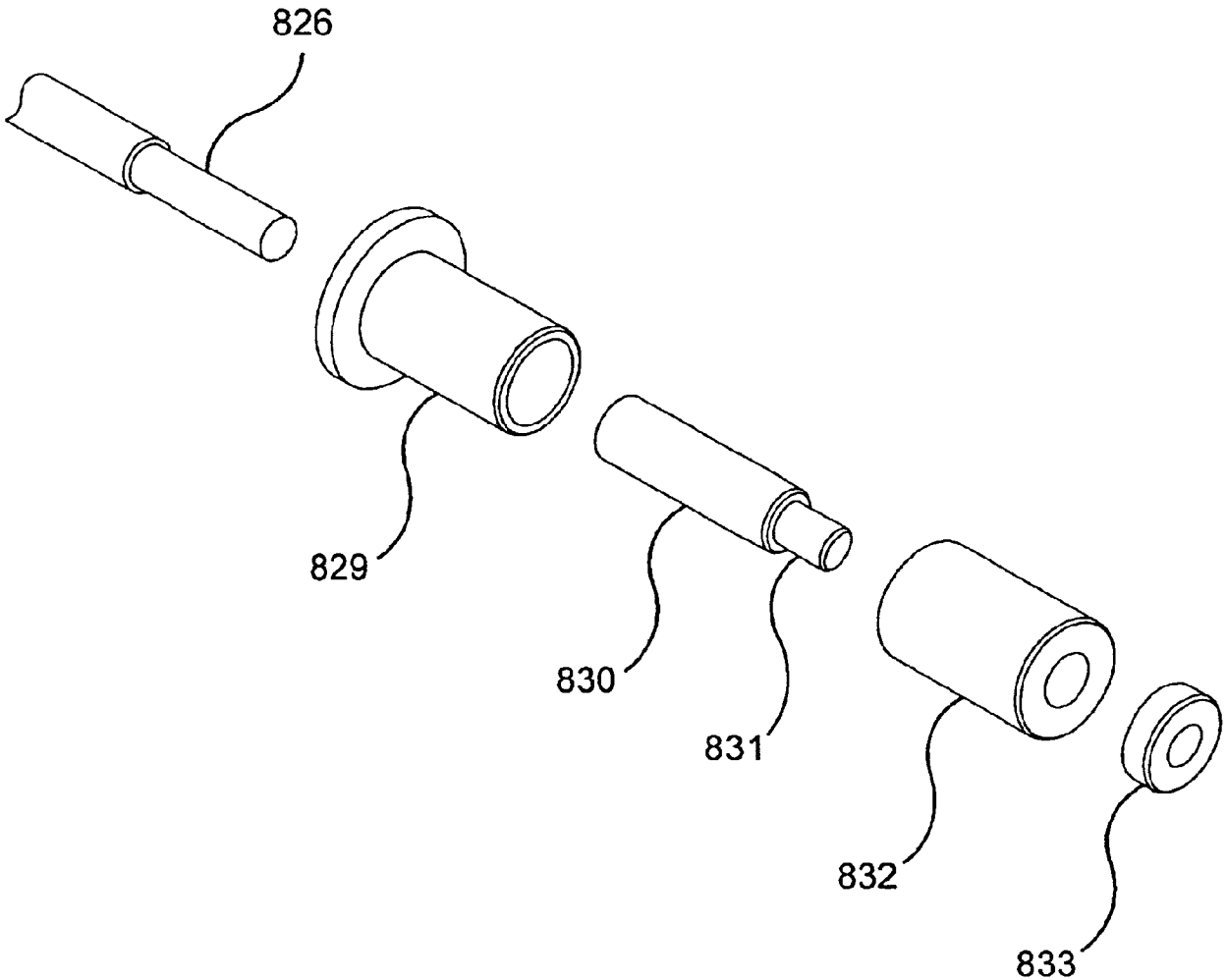
FIG. 12 is an exploded view of the operator side assembly of the take-up shaft.

FIG. 12 shows the components of the operator side assembly 828 for the take-up shaft 800 of the present invention. The first member has a cylindrical extension 826 that slides into the cylindrical opening of an axial rod 830, having an axial rod cylindrical extension 831. The axial rod cylindrical extension 831 passes through a circular opening of a handle 832 and is fastened to the handle 832 with a fastener 833. A brace 829 slides over the axial rod 830, and the handle 832 slides over the brace 829, therefore rendering the operator side assembly 828 immobile.

Figure 13:
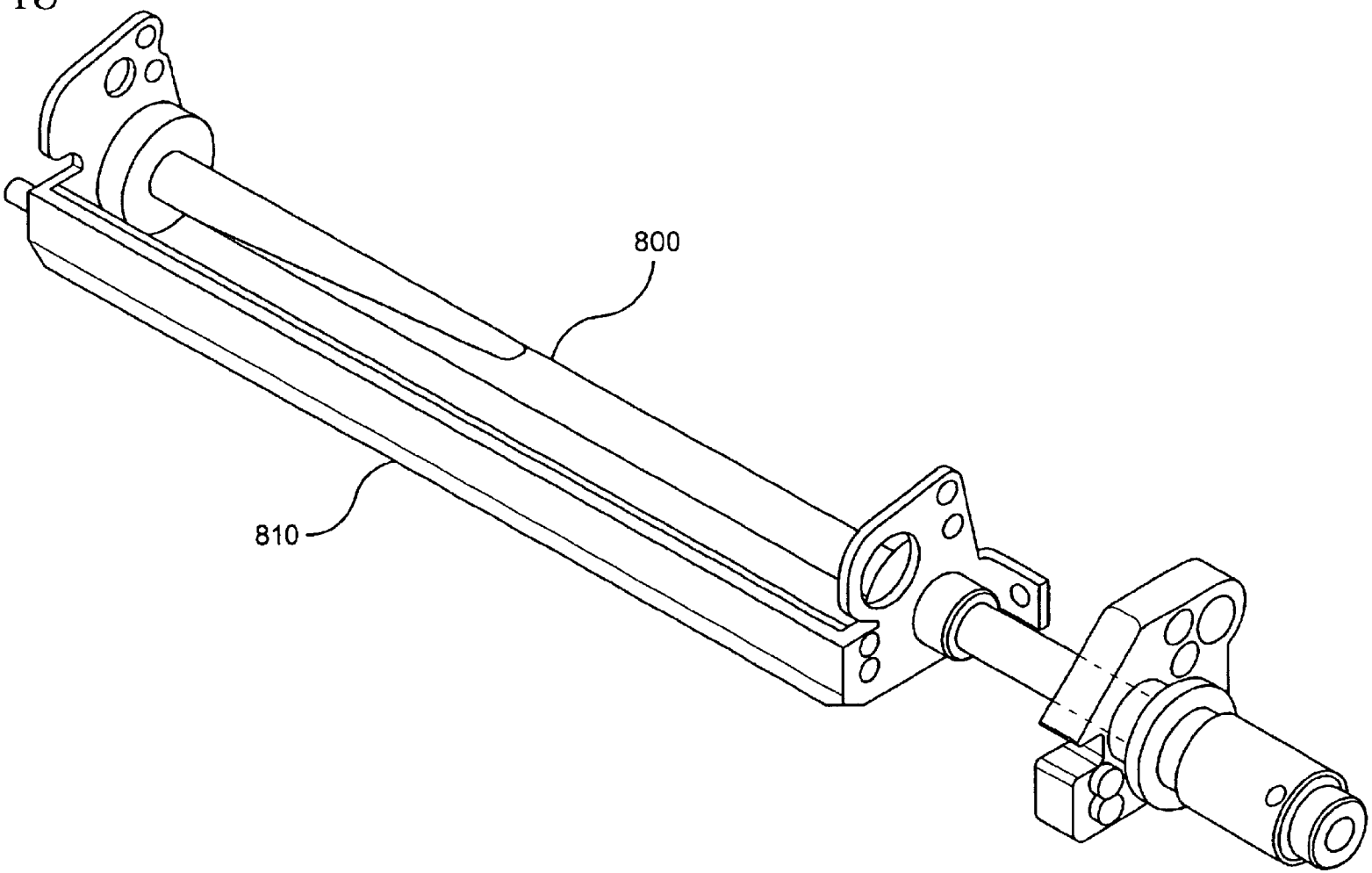
FIG. 13 is a perspective view of an assembled take-up shaft in the housing.

FIG. 13 shows the fully assembled take-up shaft 800, comprising the first member 820, the gear side assembly 827,or the securing mechanism, and the operator side assembly 828, in the housing 810. An operator of the fully assembled take-up shaft 800 would operate at the operator side assembly 828, using the handle 832. Fabric is secured between the second member 822 and the first member 820 as is described above.

Figure 14:
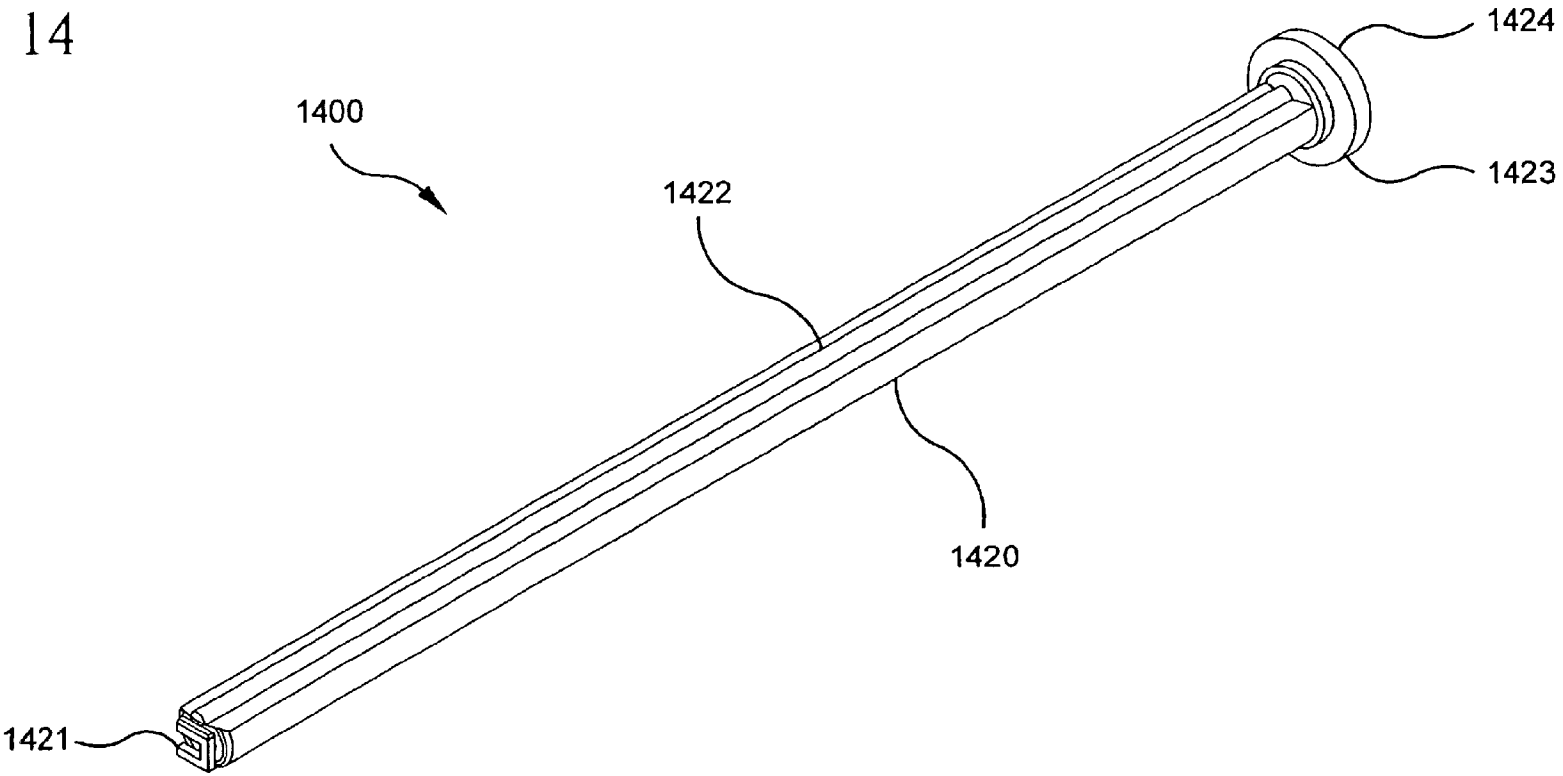
FIG. 14 is a perspective view of a take-up shaft having a rod.

As shown in FIG. 14, a take-up shaft 1400 has a first member 1420 and a second member 1422, wherein the second member may be, but is not necessarily a rod. The second member is mounted or disposed to the first member 1420 by a sliding attachment. Both ends of the first member 1420 have a rectangular extension 1421 for connecting purposes. One end of both the second member 1422 and the first member 1420 slide into a cloth take-up ring 1423, wherein the second member 1422 is above the first member 1420 and both are held immobile within a cylindrical hole of the cloth take-up ring 1423. The top of the first member 1420 is substantially flat, such that the second member 1422 rests on top of it. In other embodiments of the present invention, the first member 1420 may have an axial groove to secure the second member 1422. The tab and slot connection shown requires no connecting pieces between the second member 1422 and the first member 1420.

Figure 15:
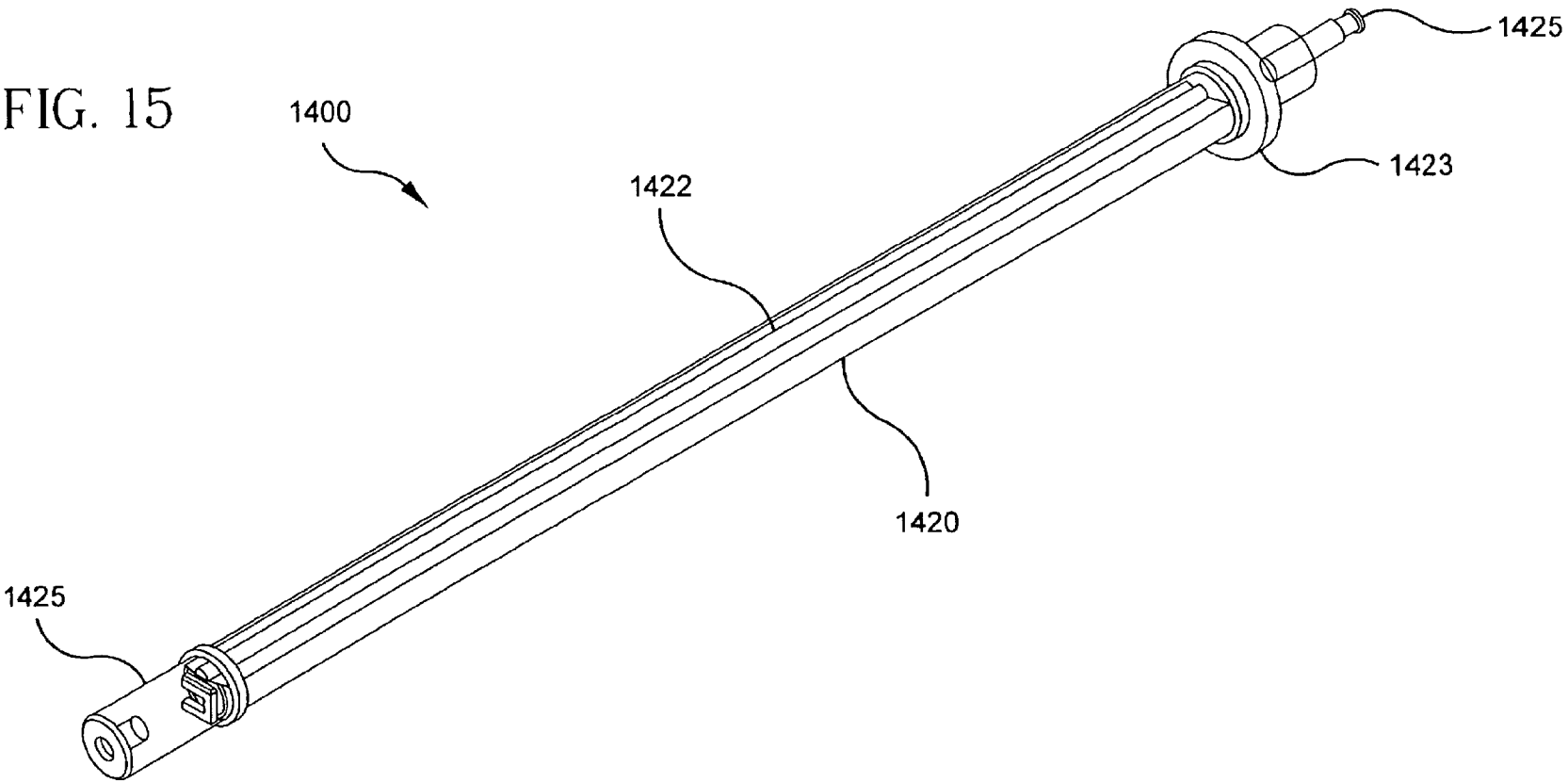
FIG. 15 is a perspective view of the take-up shaft of FIG. 13.

FIG. 15 shows one end of the first member 1420 and the second member 1422 attached to a handle 1424, for operator use. The other side of the first member 1420 and the second member 1422, being the same side connected to the cloth take-up ring 1423, are further attached to a gear assembly 1425, or securing mechanism. Fabric is secured between the mounted second member 1422 and the first member 1420 as is described above.

Figure 16:
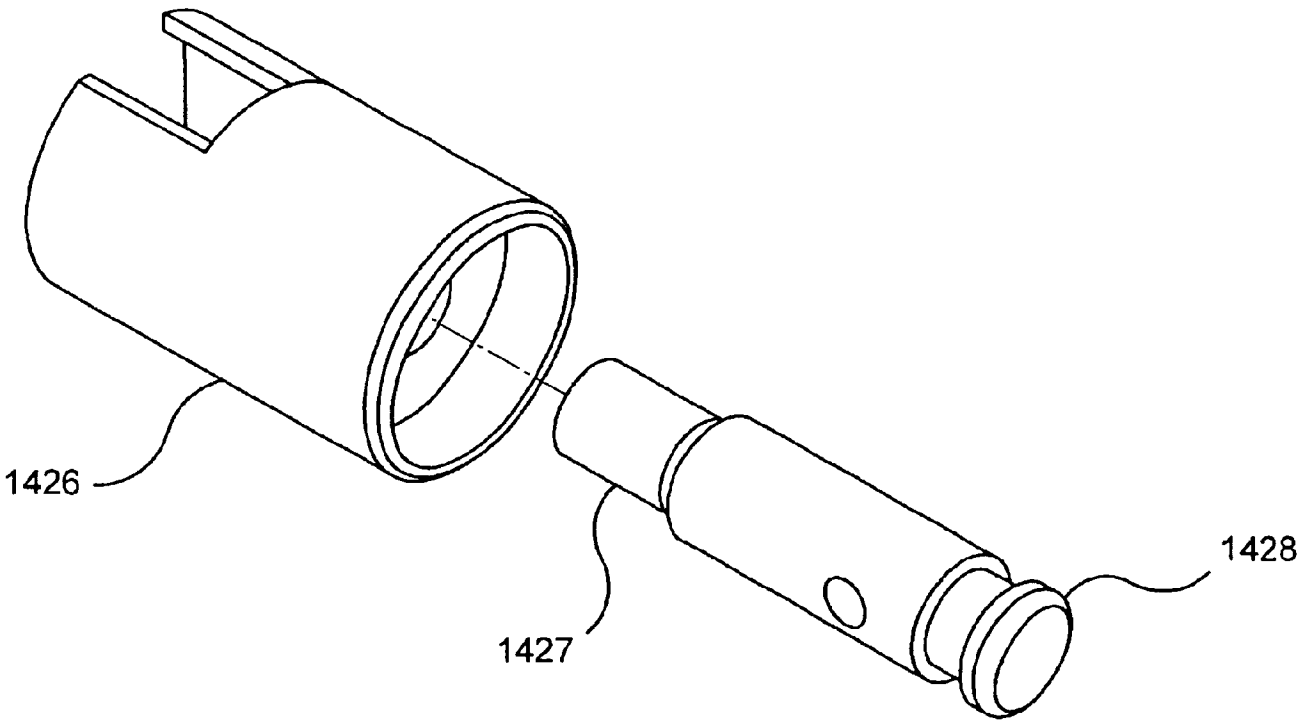
FIG. 16 is an exploded view of the gear side assembly shown in FIG. 14.

FIG. 16 shows an exploded view of the gear assembly 1425, or securing mechanism that is attached to the first member 1420. A support socket 1426 attaches at one end to a support pin 1428, having a support pin cylindrical extension 1430. The other end of the support socket 1426, attaches to the cloth take-up ring 1423, as shown in FIG. 14.

Figure 17:
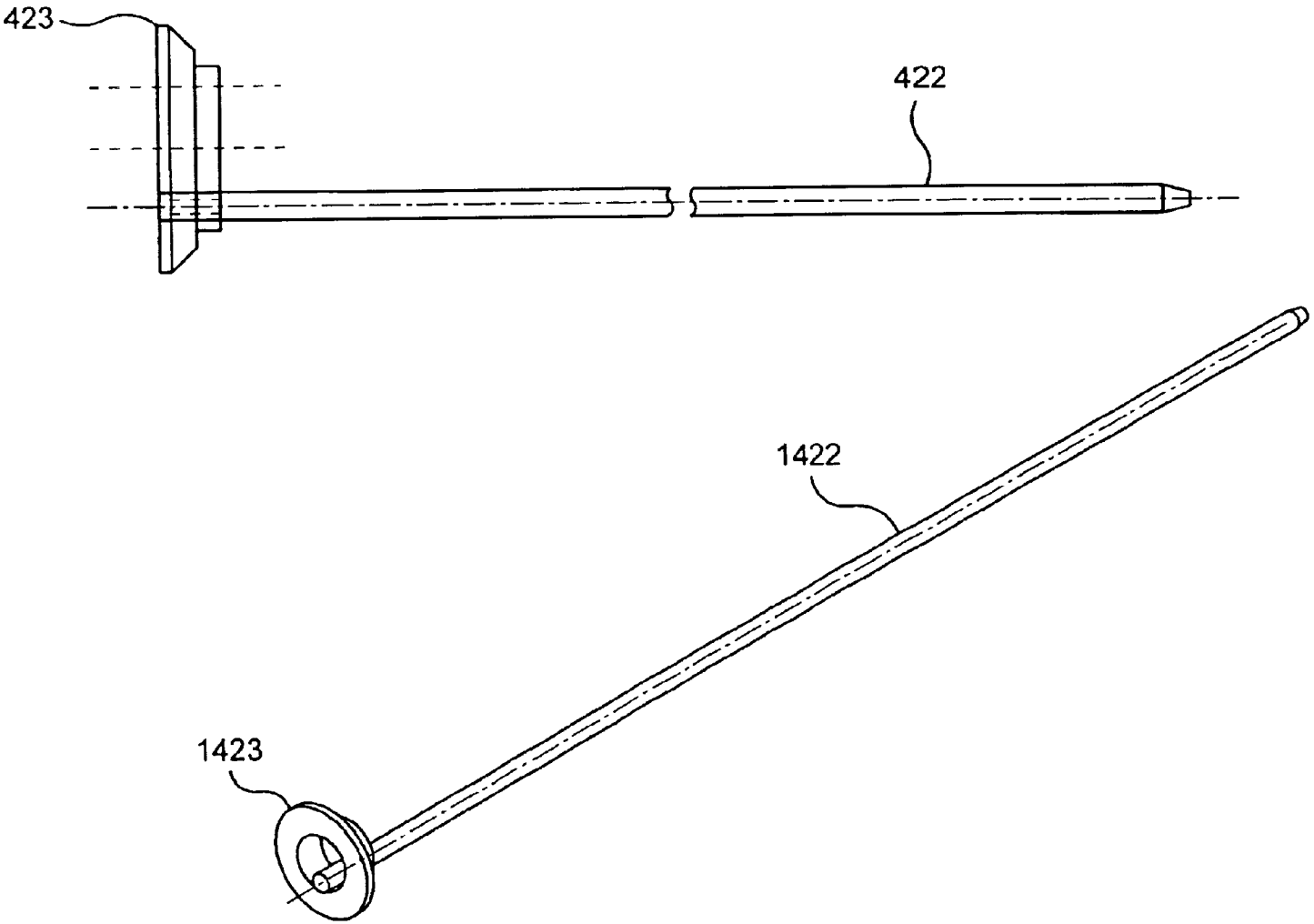
FIG. 17 is a perspective view of the take-up shaft and cloth take-up ring.
Figure 18:
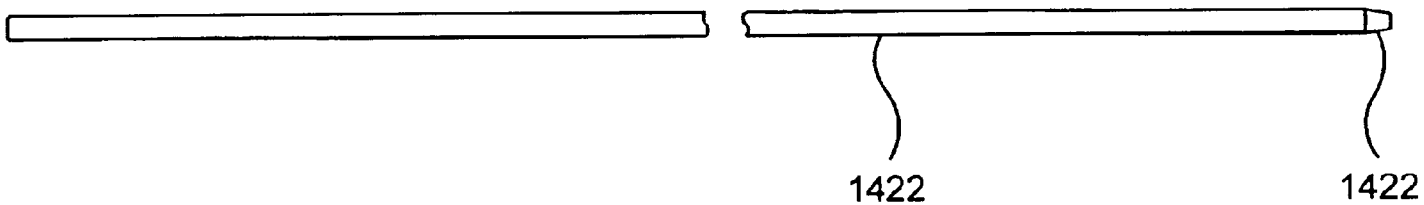
FIG. 18 is a side view of the rod shown in FIG. 14.
Figures 19, 20:
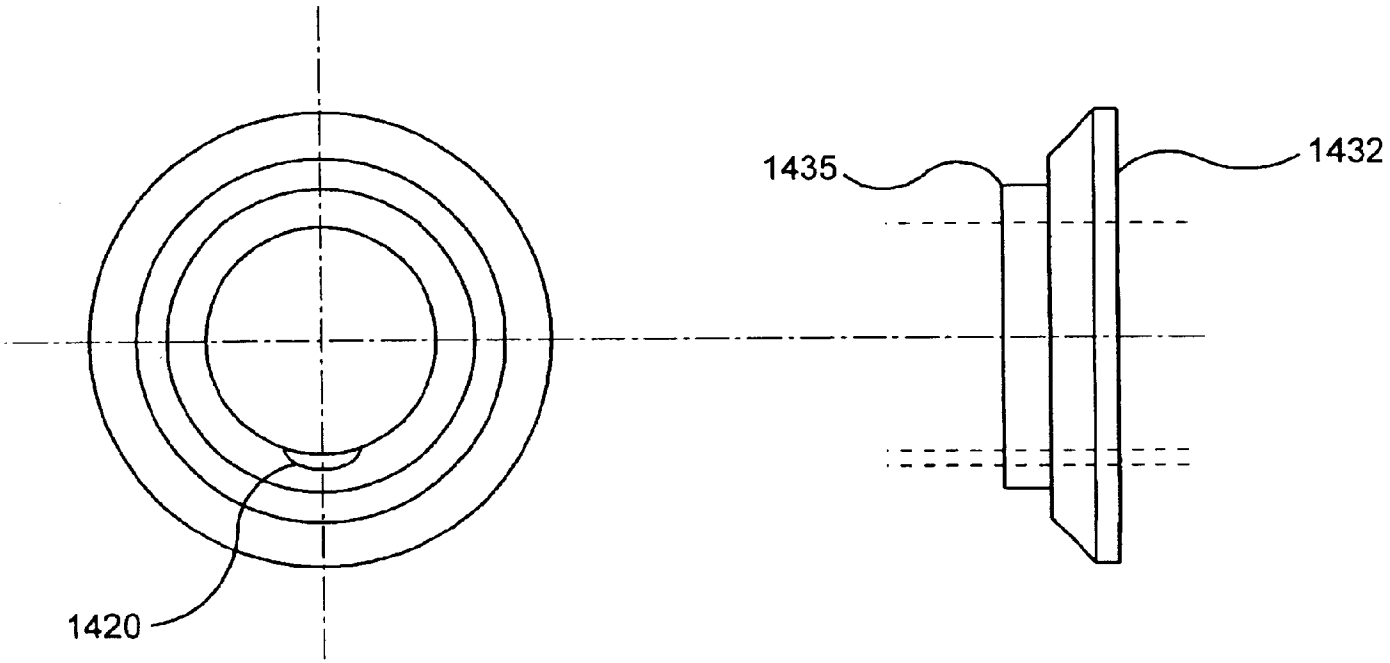
FIG. 19 is a front view of the cloth take-up ring shown in FIG. 14.
FIG. 20 is a side view of the cloth take-up ring shown in FIG. 14.

FIG. 17 is a side perspective of the second member 1422 and the cloth take-up ring 1423, without the first member 1420. One end of the second member 1422 attaches to the cloth take-up ring 1423 at an axial groove 1429 (seen in FIG. 19) of the cloth take-up ring 1423. FIG. 18 is a side view of the second member as shown in FIG. 14, without any attachment to either the first member 1420 or the cloth take-up ring 1423. One end of the second member 1422, being the end that is to be attached to the cloth take-up ring 1423 has a larger diameter than a second end of the second member 1422. The second end of the second member 1422 has an extension 1431. FIG. 19 and FIG. 20 are a side view and front view of the cloth take-up ring 1423 as shown in FIG. 14, without any attachment to either the second member 1422 or the first member 1420. The cloth take-up ring 1423 has a first ring 1432, having a first end and a second end, where the first end is substantially cylindrical and the second end is substantially conic, a second ring 1435, being substantially cylindrical and having a smaller diameter than the first ring and an axial groove 1429 for attaching to the second member 1422, where the axial groove 1435 extends through both the first ring 1432 and the second ring 1435.

Figure 21:
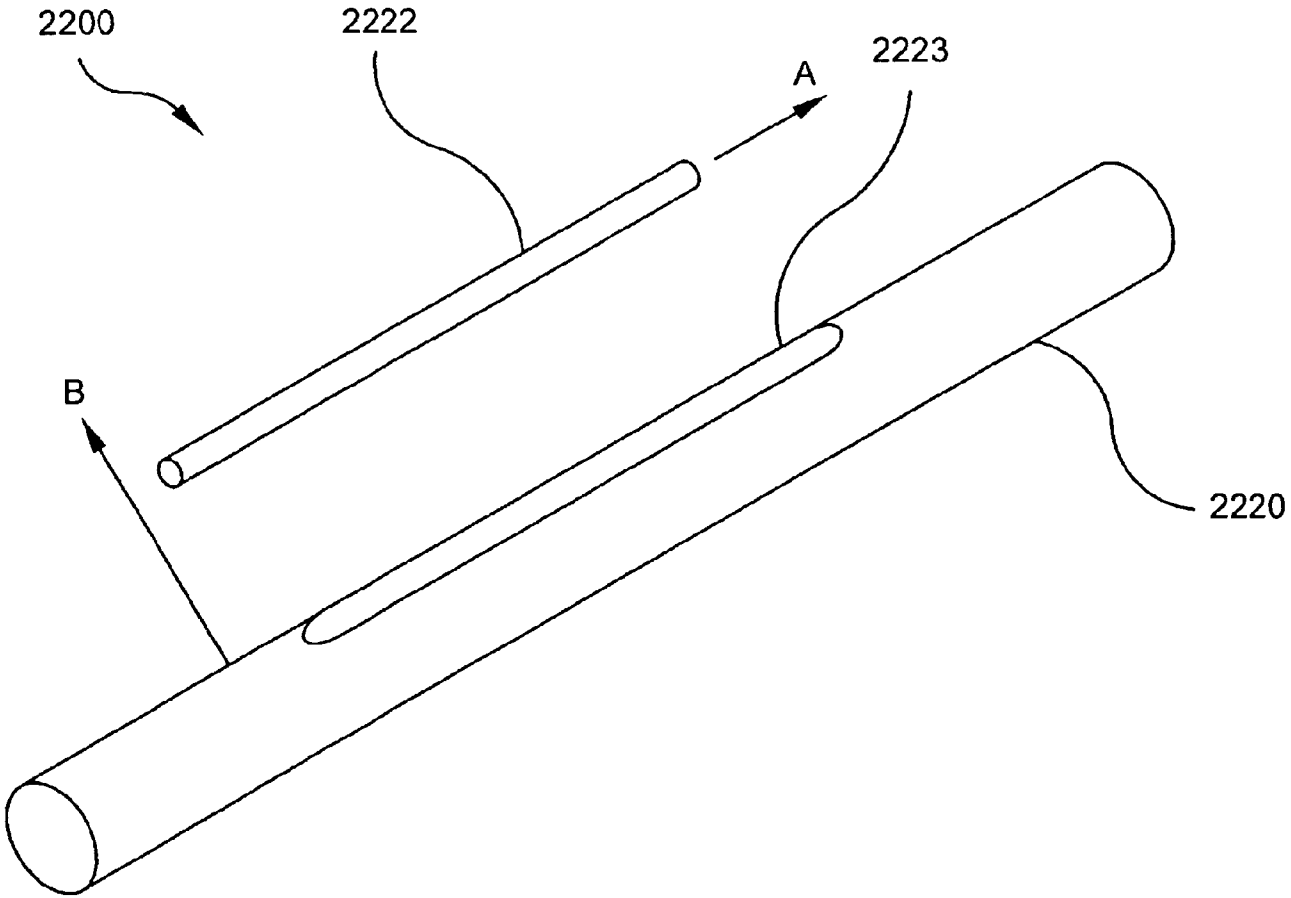
FIG. 21 is an exploded view of a take-up shaft with a rod that is assembled onto the take-up shaft.
Figure 22:
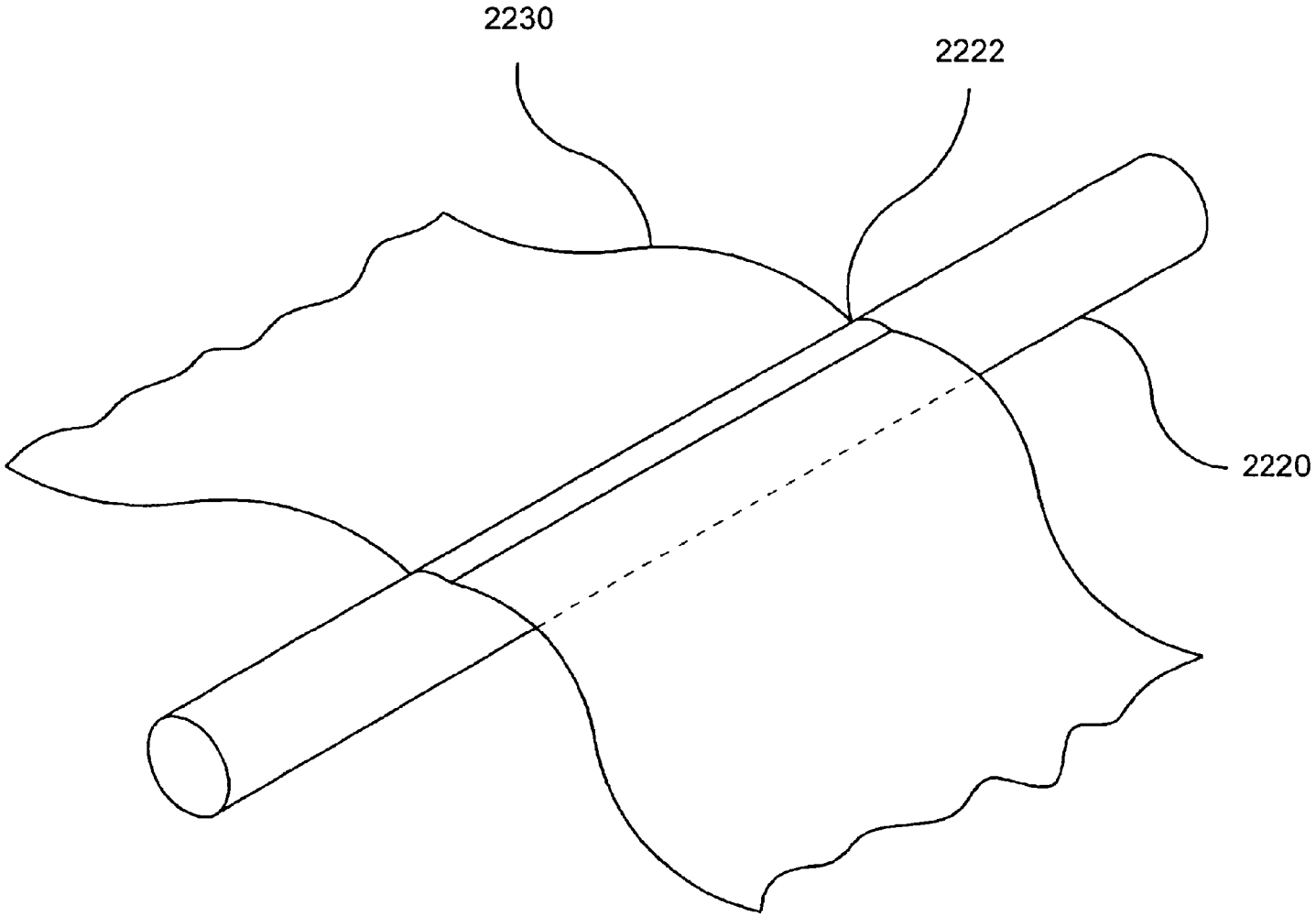
FIG. 22 is a perspective of the take-up shaft with a fabric assembled between the rod and the take-up shaft.

FIG. 21 shows an exploded view of a take-up shaft 2100 having a first member 2120 and a second member 2122, wherein the second member may be, but is not necessarily, a rod. The second member 2122 is wedged in an axial groove 2123 of the first member 2120. The axial groove 2123 is of substantially equal length to that of the second member 2122. The second member 2122 is fit into the axial groove 2123 of the first member, wherein a fabric 2130 is placed underneath the second member 2122, as shown in FIG. 22. The weight of the second member 2122 maintains is large enough to maintain enable on a rotation of the second member 2122 about and axis of its length A, without substantial motion in a transverse direction B. No components or fasteners are necessary to attach the second member 2122 to the first member 2120, or to have the fabric 2130 remain between the second member 2122 and the first member 2120.

It should be understood that the above description is only representative of illustrative examples of embodiments and implementations. For the reader's convenience, the above description has focused on a representative sample of all possible embodiments, a sample that teaches the principles of the present invention. Other embodiments may result from a different combination of portions of different embodiments. The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent.

What is claimed is:

1. An apparatus, for securing a cleaning fabric to a take-up shaft for use in a cylinder cleaning device, comprising:

a take-up shaft, for receiving a fabric, having a first member and a second member, the first member having a planar section, a first end and a second end such that the first end is substantially equal in a size to that of the second end, the second member, having a proximal the proximal end and a distal end, such that the first end is substantially equal in a size to that of the the distal end, wherein the length of the second member is substantially equal to the length of the first member, and such that the second member is disposed over the planar surface of the first member; and wherein the second member is a rod; and wherein both the first member and the second member are secured to a cloth take-up ring, by their respective ends; and wherein the cloth take-up ring is secured to a gear assembly.

2. The apparatus of claim 1, wherein the gear assembly comprises:

a support socket; and a support pin having a support pin cylindrical extension, wherein the support pin is attached to the support socket.

3. An apparatus, for securing a cleaning fabric to a take-up shaft for use in a cylinder cleaning device, comprising:

a take-up shaft, for receiving a fabric, having a first member and a second member, the first member having a planar section, a first end and a second end such that the first end is substantially equal in a size to that of the second end, the second member, having a proximal the proximal end and a distal end, such that the first end is substantially equal in a size to that of the distal end, wherein the length of the second member is substantially equal to the length of the first member, and such that the second member is disposed over the planar surface of the first member; and wherein both the first member the second member are both secured to an operator assembly by their respective ends.

4. The apparatus of claim 3, wherein the operator assembly further includes a handle.

5. The apparatus of claim 3, wherein the first member further includes a rectangular extension that attaches to the operator assembly.

6. A method, of securing a cleaning fabric to a take-up shaft for use in a cylinder cleaning device, comprising:

receiving a fabric in a take-up shaft, having a first member and a second member, the first member having a planar section, a first end and a second end such that the first end is substantially equal in a size to that of the second end, the second member, having a proximal end and a distal end, such that the proximal end is substantially equal in a size to that of the distal end, wherein the length of the second member is substantially equal to the length of the first member, and such that the second member is disposed over the planar surface of the first member; and rotating the second member of the take-up shaft in order to secure the fabric between the first member and the second member; and rotating an operator assembly that is attached to the first member and the second member of the take-up shaft in order to rotate the second member to receive the fabric.

* * * * *